United States Patent [19]

Porat et al.

[11] Patent Number: 4,679,784

[45] Date of Patent: Jul. 14, 1987

[54] FABRIC PICKUP DEVICE

[75] Inventors: Itzchak Porat; Percy Grosberg; Magid N. Moghaddassi, all of Leeds, England

[73] Assignee: Univ. of Leeds Industrial Services Limited, Leeds, England

[21] Appl. No.: 742,217

[22] Filed: Jun. 6, 1985

[30] Foreign Application Priority Data

Jun. 8, 1984 [GB] United Kingdom ..... 8414636

[51] Int. Cl.[4] ..... B65H 3/22

[52] U.S. Cl. ..... 271/18.3; 414/230; 294/61

[58] Field of Search ..... 271/18.3, 19, 10; 414/230; 901/35; 221/213, 214; 294/61, 97

[56] References Cited

U.S. PATENT DOCUMENTS

| | | | |
|---|---|---|---|
| 3,625,506 | 12/1971 | Rovin | 271/18.3 |
| 3,981,495 | 9/1976 | Bijttebier | 271/18.3 |
| 4,505,468 | 3/1985 | Heisler | 271/18.3 |
| 4,516,762 | 5/1985 | Moltrasid et al. | 271/18.3 |

FOREIGN PATENT DOCUMENTS

| | | |
|---|---|---|
| 0104272 | 12/1976 | Fed. Rep. of Germany . |
| 2062585 | 5/1981 | United Kingdom . |

*Primary Examiner*—Duane A. Reger
*Assistant Examiner*—Matthew C. Graham
*Attorney, Agent, or Firm*—Henry Sternberg; Bert J. Lewen

[57] ABSTRACT

A fabric pickup device which separates single layers from a stack of fabric layers comprises a mounting plate (1) by which it may be secured to a table (2), an angled bracket (6) extending the full width of the device, and a pickup assembly (8). The pickup assembly (8) is supplied with compressed air to operate three double-acting pneumatic cylinders (20, 21, 22). Two pickup plates (29, 30) have on their lower surfaces needles (39, 40 respectively). Operation of the cylinders (20, 21) causes the plates to be pivoted between a standby position, a pickup position in which a fabric layer is picked up on the needles, and a release position by means of a cam plate (53). Operation of cylinder (22) causes the pickup assembly to be raised so that the fabric layer picked up may be separated from the needles (39, 40).

10 Claims, 11 Drawing Figures

FABRIC PICKUP DEVICE

This invention relates to fabric pickup devices.

In mass-production methods now used in the clothing industry it is common to form a stack of fabric layers, the stack then being cut simultaneously by any one of a number of different methods in order to produce garment parts of the required shape. The parts then have to be separated from the stack for assembly into the garments. This separation is most commonly done manually. Attempts have been made to use suction methods, methods based on adhesive tape and methods based on various configurations of needles.

As an example of the latter method DE-A-2160437 describes a fabric pickup device involving two plates equipped with needles on their lower surfaces, the tips of the needles being bent so that those on one plate face away from those on the other plate. The plates can be moved vertically into contact with the uppermost one of a stack of fabric layers and the plates can then be moved horizontally away from each other so that the points of the needle tips engage the uppermost fabric layer and that layer is tensioned between the plates. The plates can then be lifted, so lifting the top layer of fabric, which can be removed from the plates by fingers pivoted thereon and located between the needles, movement of the fingers from above to below the needle points effecting the required separation. Although suitable for a number of fabrics, this arrangement will be unreliable when handling light or flimsy fabrics.

The present invention is directed to solving the problem of reliably and repeatedly separating one single layer of fabric from a stack of such layers, irrespective of the type, size or weight of the fabric. Successful mechanisation of this operation is one of the keys for automating the garment manufacturing industry, and the invention seeks to provide a device that is more effective than those hitherto proposed.

According to the invention a fabric pickup device comprises a carrier; two pickup plates lying one to each side of the carrier, each pickup plate having a lower surface with an inner edge adjacent to the carrier and an outer edge; means mounting each plate on the carrier adjacent to the inner edge of the respective plate for pivotal movement of the plates in opposite senses about parallel, substantially horizontal axes; a plurality of needles carried on the lower surface of each plate; the tips of all the needles on a plate being substantially parallel, lying at an acute angle to the lower surface of the respective plate and pointing towards the outer edge of the respective plate, and the points of all the needles on a plate being substantially coplanar; a nozzle located on the carrier between the two plates for directing an air blast downwardly between the plates; and means for pivoting the plates between a standby position wherein the tips of the needles on one plate lie at a downwardly acute angle to the tips of the needles on the other plate and below the level of the nozzle, a pickup position wherein the plates are pivoted upwardly from the standby position, said downwardly acute angle is increased and the needle points on both plates lie not below the level of the nozzle, and a release position wherein the tips of the needles on each plate lie substantially vertically and below the level of the nozzle.

In use, with the plates in the standby position they are lowered into contact with the upper surface of the top fabric layer. On engaging the fabric the plates pivot from the standby position into the pickup position, so gradually engaging the needle points with the fabric and slightly stretching the fabric between the two plates in order to tension the fabric across the air nozzle. As the plates are lifted a blast of air is provided from the nozzle, the air passing through the tensioned top layer of fabric and impinging on the lower layers, so holding these down as the top layer is lifted. The plates may then be pivoted to the release position where the fabric layer can either fall from, or be pushed from, the points of the needles. The combination of pivotally movable plates causing the fabric to be tensioned across the air nozzle, together with the effects of air from the nozzle leads to efficient separation.

Separation may be further enhanced if the device also includes a blade mounted below the level of the needle points, means for moving the blade in a first horizontal direction parallel to the pivotal axes of the plates between a withdrawn position spaced from the region directly below the plates and a separating position lying directly below the plates, and means for moving the blade in a second horizontal direction perpendicular to the first horizontal direction.

After the initial pickup and air blast a space between the top layer and the next layer immediately below the nozzle is virtually always created. Insertion of a blade into this space by movement of the blade in the first horizontal direction, and then movement of the blade in the second horizontal direction gives positive separation between the two layers over the whole of the length of travel of the blade in the second direction. If this length of travel is made not less than the width of the fabric section being lifted then the risk of lifting two loads of fabric together is reduced to a very low level. Such risk may be reduced even further by arranging for positive clamping of the lifted layer against a clamping surface, preferably in the manner as will be further described hereinafter.

In order that the invention may be better understood, a specific embodiment of a fabric pickup device in accordance therewith will now be described in more detail, by way of example only, with reference to the accompanying drawings in which.

Figure 1:
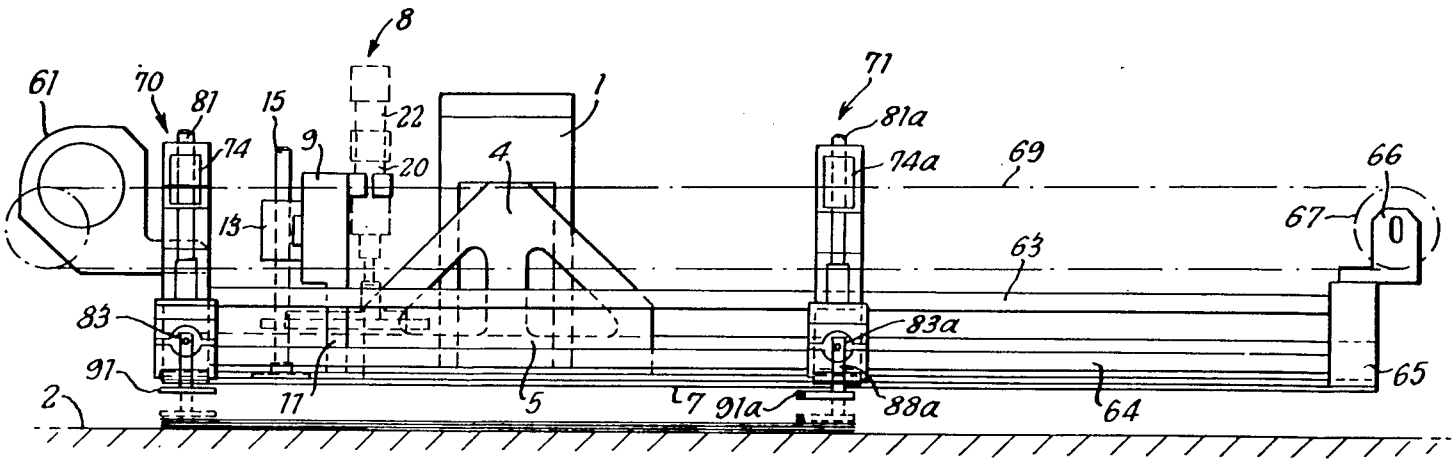
FIG. 1 is a front elevation of the device.
Figure 2:
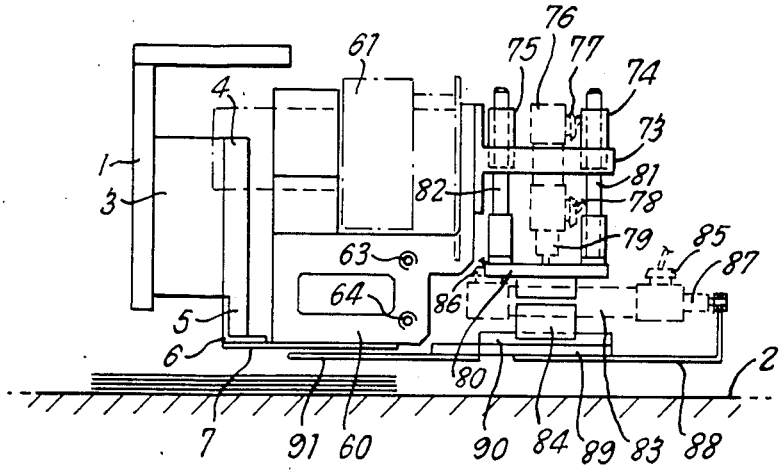
FIG. 2 is an end elevation of the device.

Referring to the drawings the device is provided with a mounting plate 1 by way of which it may be secured to a suitable support positioned above a table 2 on which may be stacked a pile of fabric layers. The support and the table may be relatively movable in either or both of the horizontal and vertical directions to ensure that the table can be loaded with fabric and presented to the device, and so that layers lifted from the table by the device can be deposited onto a further supporting surface at either the same or a different location. Such arrangements will be readily apparent to those skilled in the art, and as they are not germane to the device itself they will not be further described.

The mounting plate has a block 3 secured thereto, to which is bolted a bracket 4 having a lower member 5 of greater width than the plate 1. An angle bracket 6 extending the full width of the device has a vertical web bolted to the member 5 and a horizontal web to which is bolted a base plate 7 that again extends for the full width of the device.

Towards one end of the base plate there is mounted a pickup assembly indicated generally as 8. The assembly has a main body 9 with a compressed air connector 10 on the top thereof and with a downward extension 11. Internal passages within the body and the extension connect the air entry to a nozzle 12 at the lower part of the extension. A guide 13 is secured to the body by bolts 14 and is slidably mounted on a vertical guide rod 15 secured to the angle bracket 6 by screws 16. Clamp bars 17 and 18, together with bolts 19, secure three double acting pneumatic cylinders 20 to 22 to the body 9, each cylinder having associated upper and lower compressed air connections, such as connections 23 and 24 for the cylinder 20 and connections 25 and 26 for the cylinder 22. A piston 27 associated with the cylinder 22 is secured to the base plate by screws 28. Extension or retraction of cylinder and piston combination 22, 27 will thus cause vertical movement of the body relative to the bracket 6 and base plate 7.

Towards the lower end of the extension 11 there are provided two pickup plates 29, 30, one plate lying to each side of the carrier formed by the extension 11. Each pickup plate has a lower surface 31, 32 respectively with an inner edge 33, 34 respectively lying adjacent to the carrier and an outer edge 35, 36 respectively. The plates are mounted on the carrier adjacent their inner edges for pivotal movement about parallel, horizontal axes, 37, 38. The lower surface of each plate carries a plurality of needles 39, 40 respectively, which are conveniently provided in the form of pads of card clothing wire, with a needle density of at least sixteen needles per $cm^2$. The tips of all the needles on a plate, i.e. those sections of the needles lying outwardly of the bend or elbow thereof, are substantially parallel, lie at an acute angle to the lower surface of the respective plate and point towards the outer edge of the respective plate. The points of all the needles on a plate are substantially coplanar, and they are exposed through an opening 41 in the base plate 7.

Pistons 50 and 51 associated with cylinders 20, 21 are secured to a bar 52 from which a plate 53 having a cam slot 54 depends. The plates 29, 30 each have a roller 55, 56 rotatably mounted at the rear thereof and engaging the cam slot 54. Thus, extension and retraction of pistons 50, 51 will cause vertical movement of the cam plate 53, so enabling the plates to be pivoted between a standby position, a pickup position and a release position as will be further explained with reference to FIGS. 6 to 11.

An end plate 60 is secured to the angle bracket 6 and base plate 7 at the end thereof adjacent to the pickup assembly 8. A motor 61 driving a chain wheel 62 is mounted on the end plate 60. Also mounted on that plate are ends of two parallel slide bars 63, 64, the other ends of which are secured in a mount 65 fixed to the opposite end of the base plate 7. The mount 65 also carries a support 66 to which is secured a bearing 67 for a further chain wheel 68. A chain 69 extends between the two chain wheels 62 and 68 substantially parallel to the slide bars.

A first blade assembly 70 is fixed to the end plate 60 and a second blade assembly 71 is carried by a block 72 which is mounted on the slide bars for movement therealong.

Figure 4:
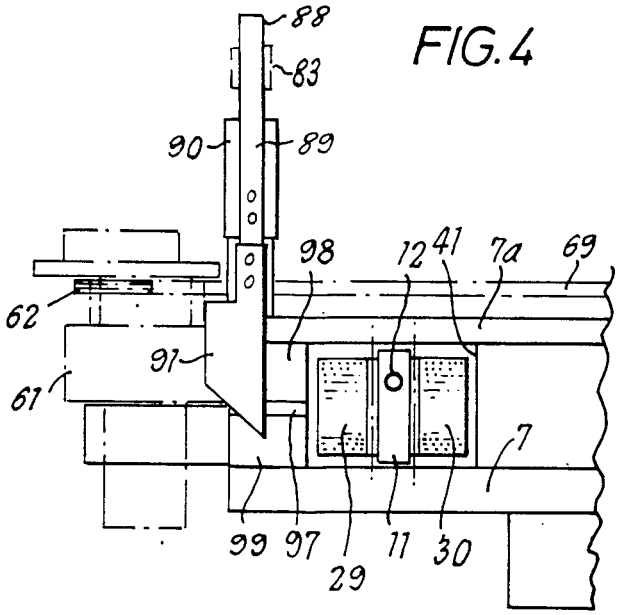
FIG. 4 is a partial bottom plan view of the device.

Apart from the blade assembly 70 being fixed and the assembly 71 being movable they are similar in construction, and only the assembly 70 will be described in detail. Corresponding parts of the assembly 71 are shown by the same reference numerals used for the assembly 70 with the suffix a. The assembly 70 has an arm 73 to which are secured two guide collars 74, 75 and on which is mounted a double acting pneumatic cylinder 76 with upper and lower air line connections 77, 78 respectively. A piston 79 associated with the cylinder is secured to a plate 80 from the upper surface of which project vertical rods 81, 82 engaging the collars 74, 75 respectively and so guiding the plate 80 for vertical movement. A further double acting pneumatic cylinder 83 is secured to the lower surfaces of the plate 80 by a clamp 84, each end of the cylinder having air line connectors 85, 86 respectively. A piston 87 associated with the cylinder is secured to an arm 88 fixed to a slide 89 movable in a slideway 90 secured to part of the clamp 84. The slide carries a blade 91. The arrangement is such that the two blades 91 and **91*a* lie horizontally and substantially in the same plane. The thickness of blade 91*a* is greater than that of blade 91 and the edge 92 of the former is formed with a groove in which the edge 93 of the latter may be received, as shown more clearly in FIG. 4**.

Figure 3:
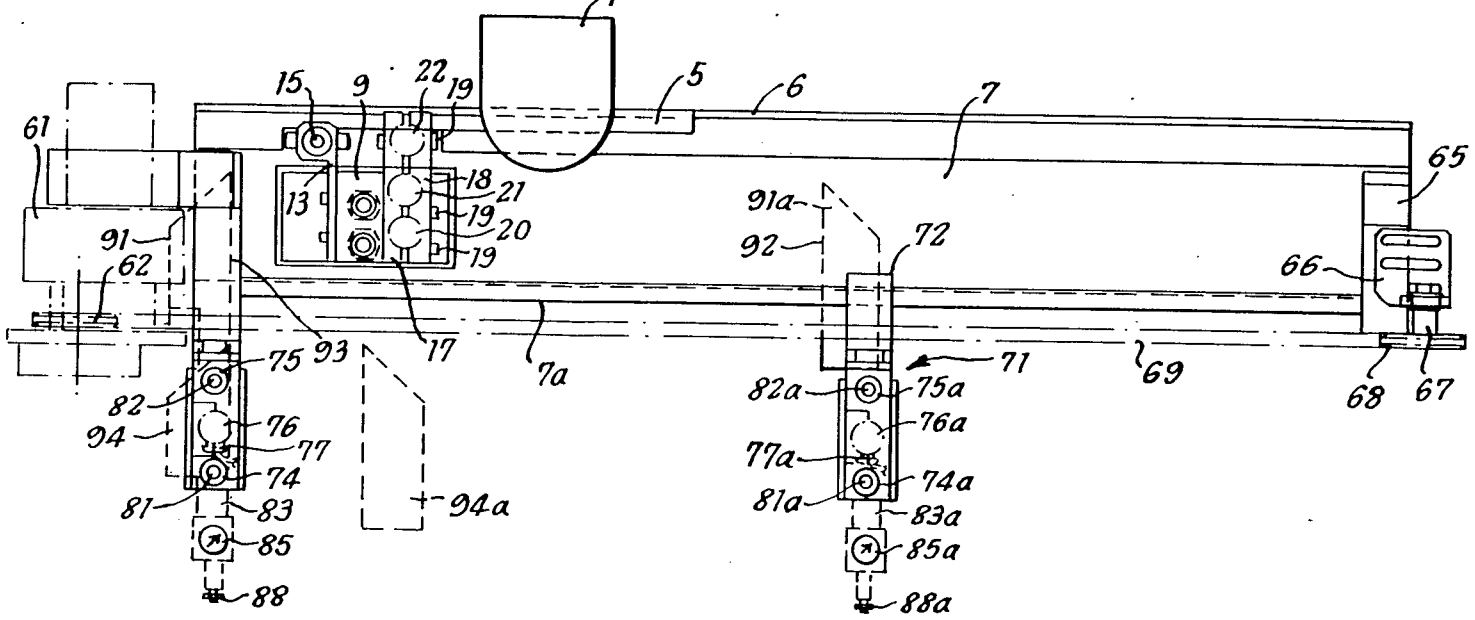
FIG. 3 is a top plan view of the device.
Figure 5:
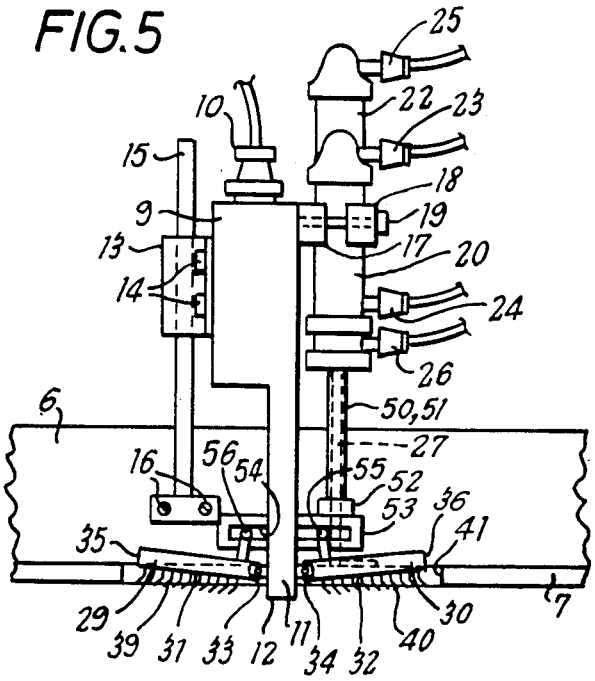
FIG. 5 is an enlarged front elevation of part of the device.
Figure 6:
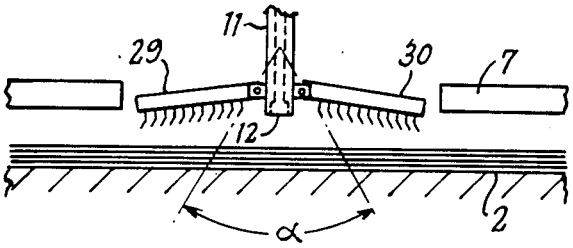
FIGS. 6 to 11 show schematically the sequence of operation of the device.

Operation of the device will now be described, it being understood that this is under the control of any suitable sequential control system. In the start condition of the device the body 9 is in a lower position relative to the base plate 7, and the two plates 29 and 30 are in a standby position as shown in FIG. 6, wherein the tips of the needles on one plate lie at a downwardly acute angle to the tips of the needles on the other plate, and wherein the points of all the needles lie below the level of the nozzle 12 and below the lower surface of the base plate 7. The blade assembly 71 is moved from the position shown in FIG. 3 to a position wherein the blade **91*a* is in line with the nozzle 12, and both the blades 91 and 91*a* are retracted to lie clear of the edge of the base plate 7, the two blades thus having the positions indicated at 94 and 94*a* respectively in FIG. 3. Additionally, the blades are lowered from the positions shown in solid lines in FIG. 1 to the positions shown in broken lines therein, lying significantly below the lower surface of the base plate. The device is positioned over a stack of fabric layers positioned on the table 2 so that an edge of the stack lies below a front edge 7*a* of the base plate 7 and so that another edge of the stack lies below that end of the base plate at which the blade assembly 70** is mounted.

Figure 7:
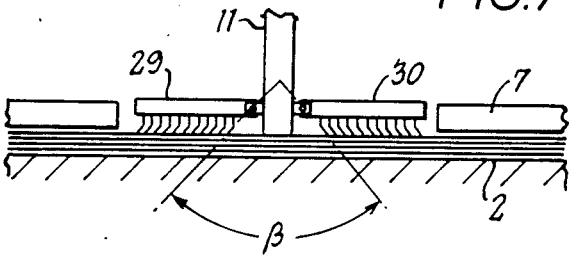
Figure 8:
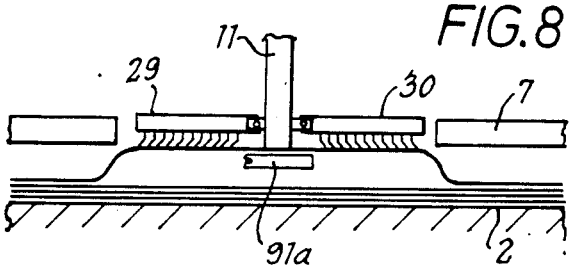

From this start position either the table 2 is raised or the pickup device is lowered so that from the FIG. 6 position the uppermost fabric layer is brought into contact with the points of the needles and the two plates 29, 30 pivot upwardly in opposite senses to the positions shown in FIG. 7. The effect of this pivoting action is to increase the angle between the needle tips from $\alpha$ to $\beta$, so gradually engaging the needle points with the fabric and also slightly stretching the fabric between the two plates so that the fabric is tensioned across the air nozzle. In the pickup position thus shown in FIG. 7 the points of the needles lie not below the level of the nozzle, and preferably slightly above that level. The next stage is either to lower the table or raise the pickup device to the position shown in FIG. 8, while simultaneously delivering a blast of air from the nozzle. The air passes through the tensioned top layer of fabric and impinges on the lower layers, so holding these down as the top layer is lifted. A space is thus created between the top fabric layer and the next layer immediately below, and the piston 87*a* associated with cylinder 83*a* is then retracted in order to insert the blade 91*a* into this space.

Figure 9:
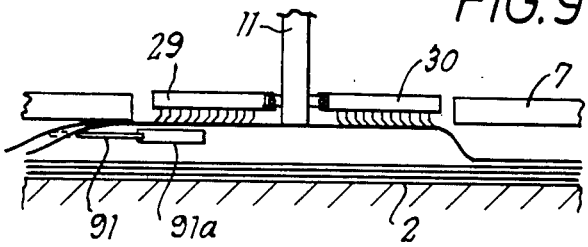
Figure 10:
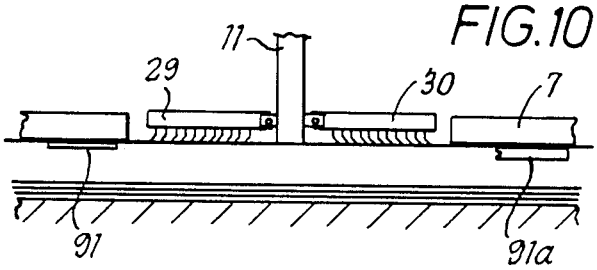
Figure 11:
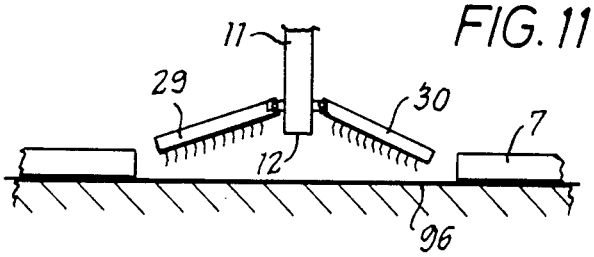

The motor 61 is then operated to move the blade assembly 71 to the left so that the blade 91*a* takes up the position shown in FIG. 9, further increasing the space between the top layer and the layer immediately below. The blade 91 is then advanced into this space by retraction of piston 87 in cylinder 83, the edge 93 of blade 91 engaging within the groove 92 in the edge of blade 91*a* to ensure that fabric is not trapped between the blades. The blade 91*a* is then moved to the right by operation of the motor to a right hand limit position that has been preset according to the shape of the fabric pieces being handled. As soon as the edges 92 and 93 of the blades have disengaged the blade 91 is raised by retraction of piston 79 in order to clamp an adjacent part of the fabric against the lower edge of the base plate 7. Once blade 91*a* has reached its limit position piston 79*a* is also retracted so that blade 91*a* similarly clamps an adjacent section of fabric against the lower surface of the base plate 7. The uppermost fabric layer has thus been positively separated from the lower layers by the action of the plates and of the blades, and the uppermost layer is securely clamped to the base plate by the blades, as shown in FIG. 10. The table with any remaining layers of fabric may then be removed and replaced by a different support surface, or the pickup device with the single fabric layer held thereby may be transported to a location above another surface 96 onto which the fabric layer is to be deposited. In order to effect such deposit, the blades are lowered and then retracted clear of the base plate 7. The cylinders 20, 21 are operated to pivot the plates 29, 30 downwardly so that the tips of the needles on each plate lie substantially vertically and below the level of the nozzle 12 as shown in FIG. 11. Cylinder 22 is then operated so that the body 9, carrying with it the plates 29 and 30 is raised relative to the base plate 7 so that the points of the needles lie above the level of the lower surface of the base plate. The fabric layer is thus positively separated from the needles and deposited on the surface 96. The pickup device can then be raised from that surface and all parts returned to their original positions.

The device described is capable accurately of separating single layers from a stack of fabric layers consistently and reliably. However, there may be isolated instances wherein no layer or more than one layer is inadvertently picked up, and it is useful to be able to detect this. One convenient method of detecting the absence of any layer is to form a section of the base plate that lies immediately above the blade 91 with an electrically conductive strip 97 positioned between two insulating sections 98 and 99. With a metal blade 91 it can be arranged for a circuit to be completed when that blade contacts the strip 97 in order to give an indication that no layer lies between these two parts. The device can then be controlled to return to the pile of fabric layers for a second attempt. If the blade 91 is in its withdrawn position while the device is attempting the pickup action then contact between the strip 97 and a metal table could indicate exhaustion of the pile of fabric layers and generate a signal accordingly.

A ply detector that may be used to detect the presence of more than one ply on the carrier may comprise means for drawing a vacuum through the layers of fabric that are carried by the pickup device, and for measuring the air permeability of the fabric. Significant differences in air permeability occur between suction through one layer or more than one layer, and this difference may be detected in order to generate an appropriate signal.

It will be clear that many modifications can be made to the apparatus particularly described. In particular, any mechanical, electrical, or fluid-powered means may be utilised for effecting the relative movement of the various parts, and the invention is not limited to the use of the double acting pneumatic rams described. It is not necessary to use carding wire for the needles, although this is a particularly convenient method. Any type of needle arrangement that will provide needle tips at a suitable angle may be used. An acute angle between the tips and the lower surface of the plate chosen to be from 20° and 80° will generally be suitable. In the described embodiment fabric release from the needles is assisted by mounting the plates so that they may be moved bodily relative to the base plate to project through an opening in the base plate to effect pickup or to be moved to above the base plate level on release. However, this is not essential, and at least with some fabrics release may be effected by merely allowing the fabric to fall from the needles when their tips are vertical. If assisted release is required then it may be achieved in ways other than that described.

We claim:

1. A fabric pickup device comprising a carrier; two pickup plated lying one to each side of the carrier, each pickup plate having a lower surface with an inner edge adjacent to the carrier and an outer edge; means mounting each plate on the carrier adjacent to the inner edge of the respective plate for povotal movement of the plates in opposite senses about parallel. substantially horizontal axes; a plurality of needles carried on the lower surface of each plate; the tips of all the needles on a plate being substantially parallel. lying at an acute angle to the lower surface of the respective plate and pointing towards the outer edge of the respective plate, and the points of all the needles on a plate being substantially coplanar and adapted to engage a fabric layer; a nozzle located on the carrier between the two plates for directing an air blast downwardly between the plates; and means for pivoting the plates between a standby position wherein the tips of the needles on one plate lie at a downwardly acute angle to the tips of the needles on the other plate and below the level of the nozzle, a fabric pickup position wherein the plates are pivoted upwardly from the standby position while in engagement with the fabric layer, said downwardly acute angle is increased and the needle points on both plates lie not below the level of the nozzle and tension the fabric layer acrosss the nozzle, and a release position wherein the tips of the needles on each plate lie substantially vertically and below the level of the nozzle.

2. A device according to claim 1 and including a frame surrounding the combined periphery of the carrier and the plates, said carrier and said plates together comprising a carrier/plate means, and means for causing relative vertical movement between said frame and said carrier/plate means between a first position wherein a lower surface of the frame lies above the tips of the needle to a second position wherein that lower surface lies below the tips of the needles.

3. A device according to claim 1 in which the needle density on each plate is at least 16 needles per $cm^2$.

4. A device according to claim 1 in which each plate carries a pad of carding wire forming the needles.

5. A device according to claim 1 and including a blade mounted below the level of the needle points, means for moving the blade in a first horizontal direction parallel to the pivotal axes of the plates between a withdrawn position spaced from the region directly below the plates and a separating position lying directly below the plates, and means for moving the blade in a second horizontal direction perpendicular to the first horizontal direction.

6. A device according to claim 5 in which means are also provided for moving the blade in a vertical direction towards and away from a clamping surface extending above the path of travel of the blade in the second horizontal direction.

7. A device according to claim 5 and including a second blade mounted below the level of the needle points, means for moving the second blade in a first horizontal direction parallel to the pivotal axes of the plates between a withdrawn position and a separating position, and means for moving the second blade in a vertical direction towards and away from the clamping surface.

8. A device according to claim 5 in which the first said blade, at one limit of its travel in the second horizontal direction, lies in side-by-side contact with the second blade.

9. A device according to claim 8 in which an edge of one of the blades is received in a groove formed in an edge of the other blade when the two blades are in side-by-side contact.

10. A device according to claim 1 wherein, in said pickup position, the needle points on both plates lie slightly above the level of the nozzle.

* * * * *

UNITED STATES PATENT AND TRADEMARK OFFICE

CERTIFICATE OF CORRECTION

PATENT NO. : 4,679,784

DATED : July 14, 1987

INVENTOR(S) : Itzchak Porat et al.

It is certified that error appears in the above-identified patent and that said Letters Patent is hereby corrected as shown below:

Col. 6, claim 1, line 32, delete "plated" and substitute therefor --plates--.

Col. 6, claim 1, line 41. after "parallel" delete "." and substitute therefor --,--.

Signed and Sealed this

First Day of December, 1987

*Attest:*

DONALD J. QUIGG

*Attesting Officer*

*Commissioner of Patents and Trademarks*